US010167831B2

(12) United States Patent
Herr et al.

(10) Patent No.: US 10,167,831 B2
(45) Date of Patent: Jan. 1, 2019

(54) ACCUMULATOR CENTERING MECHANISM

(71) Applicant: Caterpillar Inc., Peoria, IL (US)

(72) Inventors: Michael Curtis Herr, Tremont, IL (US); Joshua David Carlson, Peoria, IL (US)

(73) Assignee: Caterpillar Inc., Deerfield, IL (US)

( * ) Notice: Subject to any disclaimer, the term of this patent is extended or adjusted under 35 U.S.C. 154(b) by 19 days.

(21) Appl. No.: 15/406,368

(22) Filed: Jan. 13, 2017

(65) Prior Publication Data

US 2018/0202400 A1 Jul. 19, 2018

(51) Int. Cl.

| | |
|---|---|
| ***F02M 55/02*** | (2006.01) |
| ***F02M 55/00*** | (2006.01) |
| ***F02M 53/04*** | (2006.01) |
| ***F02F 1/24*** | (2006.01) |
| ***F02M 61/16*** | (2006.01) |

(52) U.S. Cl.

CPC ..... *F02M 55/02* (2013.01); *F02F 1/242* (2013.01); *F02M 53/04* (2013.01); *F02M 55/005* (2013.01); *F02M 55/008* (2013.01); *F02M 55/025* (2013.01); *F02M 61/168* (2013.01)

(58) Field of Classification Search

CPC .... F02M 55/02; F02M 55/025; F02M 55/005; F02M 55/008

USPC ..... 123/294, 467, 468, 447, 456

See application file for complete search history.

(56) References Cited

U.S. PATENT DOCUMENTS

| | | | | |
|---|---|---|---|---|
| 6,199,539 | B1 * | 3/2001 | Pearlman | F02M 55/005 123/469 |
| 6,237,570 | B1 | 5/2001 | Denso | |
| 6,279,540 | B1 * | 8/2001 | Greaney | F02M 55/002 123/468 |
| 8,069,842 | B2 | 12/2011 | Bosch | |
| 2009/0183713 | A1 * | 7/2009 | Bonfigli | F02M 55/005 123/445 |

FOREIGN PATENT DOCUMENTS

| | | | |
|---|---|---|---|
| EP | 0915253 | A2 | 5/1999 |
| WO | WO-2012/102635 | A1 | 8/2012 |

* cited by examiner

*Primary Examiner* — Mahmoud Gimie

(74) *Attorney, Agent, or Firm* — Miller, Matthias & Hull

(57) ABSTRACT

A resilient seal member disposed in an alignment groove of an accumulator body centers the accumulator body in an oversized accumulator bore of a cylinder head to prevent assembly damage. The seal member can compress to allow the accumulator body to move off center within the accumulator bore so that an end may be received by and form a seal with a port of a fuel injector. The alignment groove and the seal member are configured so that cooling fluid can flow past the seal member when the accumulator body is installed. In one implementation, the accumulator body includes at least one fluid flow channel at the alignment groove having a depth greater than the alignment groove so fluid can flow through the channel to pass the seal member.

20 Claims, 7 Drawing Sheets

ACCUMULATOR CENTERING MECHANISM

TECHNICAL FIELD

The present disclosure relates generally to common rail fuel injection systems for engines for machines and vehicles and, more particularly, to an accumulator assembly having a centering mechanism aligning an accumulator body within a bore of a cylinder head and allowing flow of cooling fluid past the centering mechanism.

BACKGROUND

Common rail direct fuel injection is a direct fuel injection system for gasoline and diesel engines in various applications, such as in providing power to machines and vehicle. In diesel engines for example, a common rail fuel injection system may feature a high-pressure fuel rail having a plurality of fuel lines each feeding an individual accumulator assembly with a valve to provide the high-pressure fuel to a corresponding fuel injector for one of the combustion cylinders of the engine. FIG. 1 illustrates an example of a known engine assembly 10 with an accumulator assembly 12 that will be inserted into a cylinder head 14. The accumulator assembly 12 includes an accumulator body 16, a fuel line adapter 18 and an accumulator clamp 20. The accumulator body 16 is generally cylindrical with an accumulator body longitudinal axis 22 and an accumulator body outer surface 24 defining a series of body sections 26, 28, 30, 32 with an accumulator body outer diameter increasing as the accumulator body 16 extends from an injector interface end 34 toward the fuel line adapter 18 and the accumulator clamp 20.

The cylinder head 14 shown in cross-section includes an accumulator bore surface 40 defining an accumulator bore 42 extending inwardly into the cylinder head 14 from an accumulator bore opening 44 in a cylinder head outer surface 46. The accumulator bore 42 has a shape that is complimentary to a shape of the accumulator body 16 with a series of bore sections 48, 50, 52, 54 corresponding to the body sections 26, 28, 30, 32, respectively, and having an accumulator bore inner diameter that increases relative to an accumulator bore longitudinal axis 56. The cylinder head 14 may further include a drain passage 58 connecting a drain port 60 of the cylinder head 14 to the accumulator bore 42. The accumulator bore surface 40 intersects a fuel injector bore surface 62 defining a fuel injector bore 64 extending inwardly into the cylinder head 14 from an injector bore opening 66 in the cylinder head outer surface 46 at a bore intersection area 68.

The accumulator body 16 is inserted into the accumulator bore 42 until the injector interface end 34 reaches the bore intersection area 68 (FIG. 2). A fuel injector 70 (FIG. 3) is installed in the injector bore 64 before the accumulator body 16 is inserted. The fuel injector 70 has a high pressure fluid inlet port 72 that is aligned at the bore intersection area 68 and approximately aligned with the accumulator bore longitudinal axis 56. When the accumulator body 16 is inserted into the accumulator bore 42, the injector interface end 34 enters the bore intersection area 68 and is received by the high pressure fluid inlet port 72 of the fuel injector 70. The injector interface end 34 and the high pressure fluid inlet port 72 have complimentary shapes so that the end 34 is guided into the port 72 and a seal is formed there between. High pressure fluid is provide through an accumulator body bore 74 to a high pressure fluid supply port 76 of the accumulator body 16 at the end 34 and to a high pressure fuel passage 78 of the fuel injector 70. The accumulator body outer diameter at each of the body sections 26, 28, 30, 32 is less than the accumulator bore inner diameter at the corresponding bore sections 48, 50, 52, 54, respectively, so that an annular gap 80 between the accumulator body outer surface 24 and the accumulator bore surface 40 is present when the injector interface end 34 is received by the high pressure fluid inlet port 72. The annular gap 80 allows cooling fluid to flow back from the fuel injector bore 64 through a cooling fluid port (not shown) at the bore intersection area 68, through the annular gap 80 in the direction indicated by arrows 82, and out of the cylinder head 14 through the drain passage 58 and the drain port 60.

SUMMARY OF THE DISCLOSURE

In one aspect of the present disclosure, an accumulator body for an accumulator assembly in an engine assembly of a machine is disclosed. The engine assembly further includes a fuel injector having a high pressure fluid inlet port, and a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned. The accumulator body includes an injector interface end dimensioned to be received by the high pressure fluid inlet port of the fuel injector, and an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis. The accumulator body further includes an alignment groove surface defining an alignment groove in the accumulator body outer surface having an alignment groove depth that is radially inward from the accumulator body outer surface and an alignment groove longitudinal width, and a first fluid flow channel surface defining a first fluid flow channel in the accumulator body that is disposed at the alignment groove. The first fluid flow channel has a fluid flow channel depth that is radially inward from the accumulator body outer surface and is greater than the alignment groove depth, and a fluid flow channel longitudinal length that is at least equal to the alignment groove longitudinal width.

In another aspect of the present disclosure, an accumulator assembly for an engine assembly of a machine is disclosed. The engine assembly further includes a fuel injector having a high pressure fluid inlet port, and a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned. The accumulator assembly includes an accumulator body and a seal member disposed on the accumulator body. The accumulator body includes an injector interface end dimensioned to be received by the high pressure fluid inlet port of the fuel injector, an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis, and an alignment groove surface defining an alignment groove in the accumulator body outer surface having an alignment groove depth that is radially inward from the accumulator body outer surface and an alignment groove longitudinal width. The seal member is disposed within the alignment groove and has a seal inner edge surface engaging the alignment groove surface to prevent fluid flow there between, and a seal outer edge surface having a plurality of accumulator bore engagement portions that extend radially outwardly beyond the accumulator body outer surface and engage the accumulator bore surface to align the accumulator body for insertion of the injector interface end into the high pressure fluid inlet port of the fuel injector. The seal outer edge surface does not engage the accumulator bore surface between adjacent accumulator bore engagement portions so that cooling fluid can flow past the seal member between the seal outer edge surface and the accumulator bore surface.

In a further aspect of the present disclosure, an engine assembly of a machine is disclosed. The engine assembly may include a fuel injector having a high pressure fluid inlet port, a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned, an accumulator body and a seal member disposed on the accumulator body. The accumulator body includes an injector interface end dimensioned to be received by the high pressure fluid inlet port of the fuel injector, an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis, and an alignment groove surface defining an alignment groove in the accumulator body outer surface having an alignment groove depth that is radially inward from the accumulator body outer surface and an alignment groove longitudinal width. The seal member is disposed within the alignment groove and having a seal inner edge surface engaging the alignment groove surface and a seal outer edge surface engaging the accumulator bore surface to align the accumulator body for insertion of the injector interface end into the high pressure fluid inlet port of the fuel injector. The alignment groove and the seal member are configured so that cooling fluid can flow past the seal member when the accumulator body is installed in the accumulator bore and the seal outer edge surface engages the accumulator bore surface.

Additional aspects are defined by the claims of this patent.

DETAILED DESCRIPTION

Figure 1:
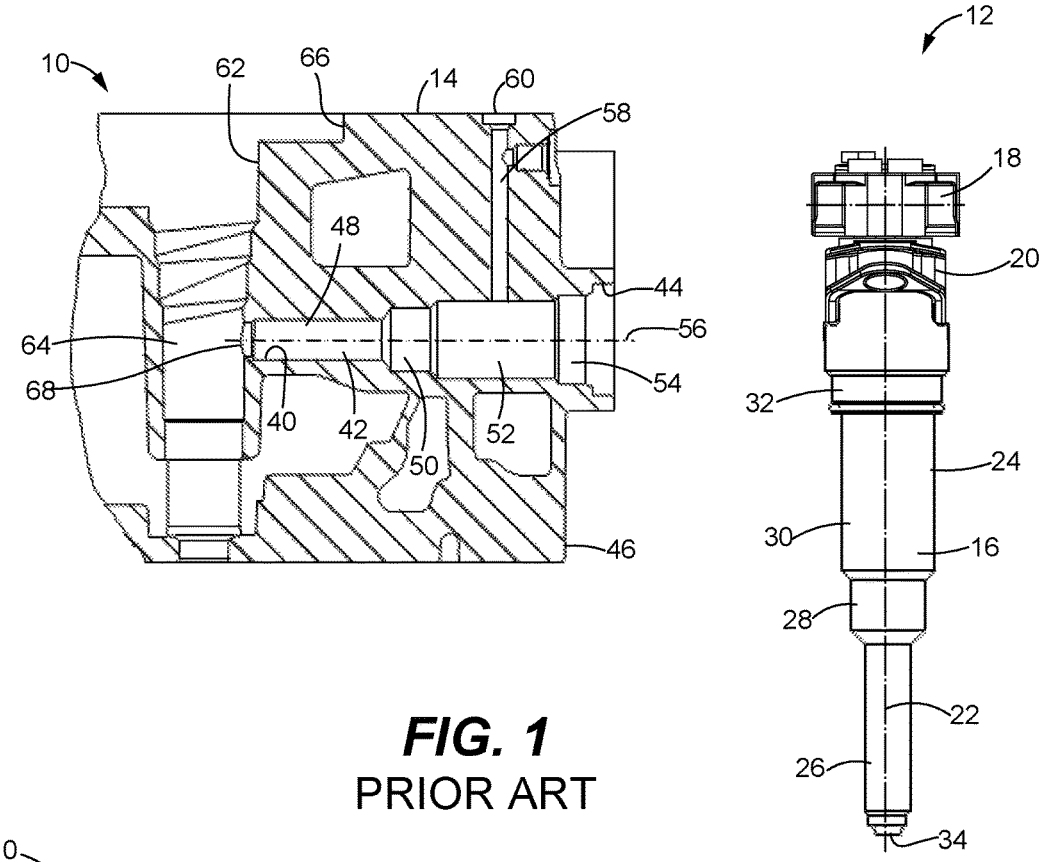
FIG. 1 PRIOR ART
FIG. 1 is a side view of a portion of an engine assembly for a vehicle or machine, including a portion of a cylinder head shown in cross-section and an accumulator assembly previously known in the art with the accumulator assembly not installed in the cylinder head.
Figure 2:
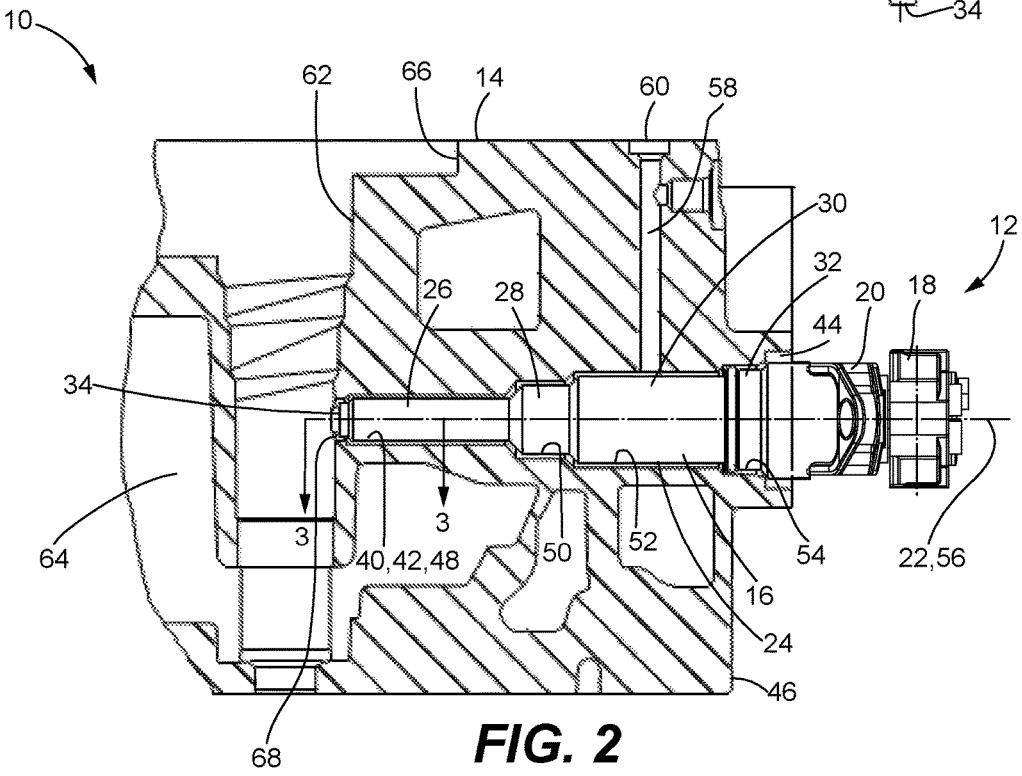
FIG. 2 PRIOR ART
FIG. 2 is the side view of the portion of the engine assembly of FIG. 1 with the accumulator assembly installed in the cylinder head and without a corresponding fuel injector installed.
Figure 3:
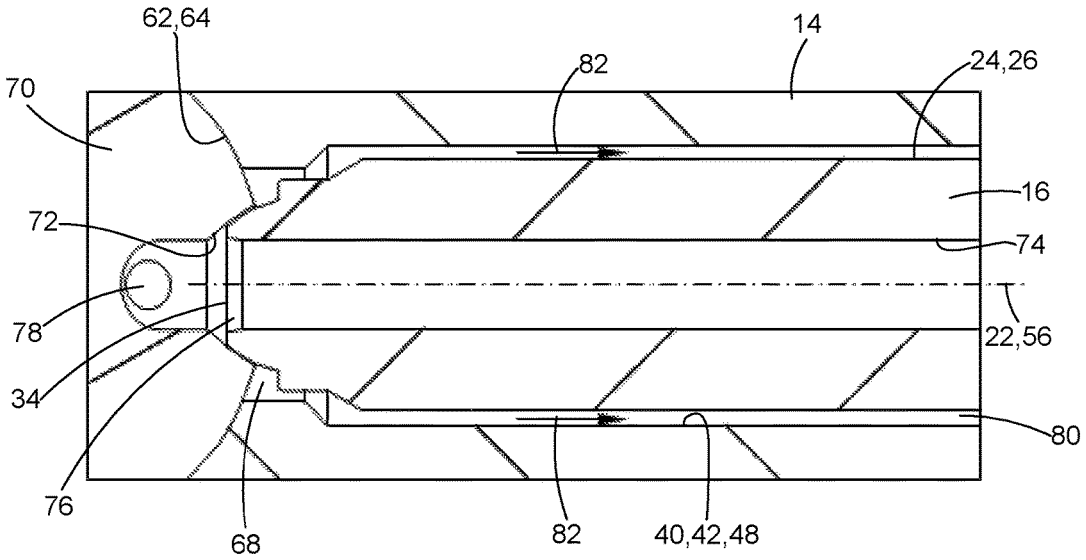
FIG. 3 PRIOR ART
FIG. 3 is a partial cross-sectional view of the assembled engine assembly of FIG. 2 taken through line 3-3 and with a fuel injector installed in the cylinder head.
Figure 4:
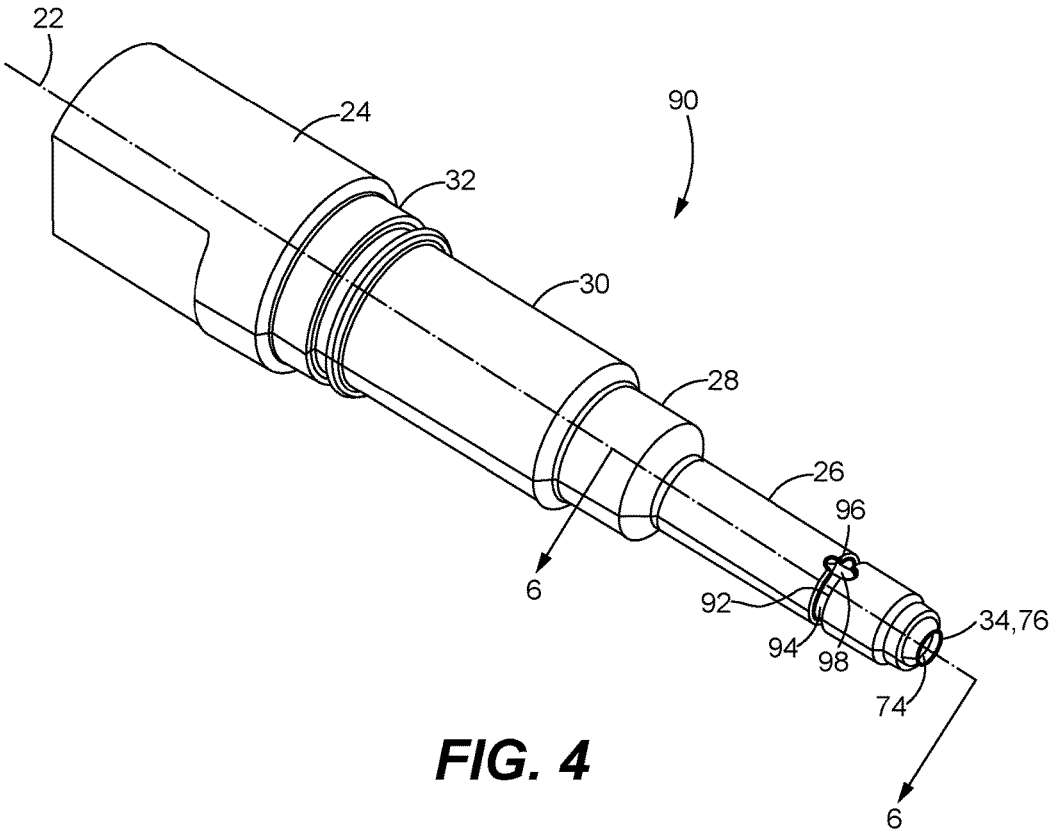
FIG. 4 is an isometric view of an embodiment of an accumulator body in accordance with the present disclosure.

FIG. 4 illustrates an embodiment of an accumulator body 90 in accordance with the present disclosure for use in the accumulator assembly 12 as an alternative to the accumulator body 16. Elements of the accumulator body 90 corresponding to similar elements described for the accumulator body 16 are identified with the same reference numerals and their descriptions will not be repeated hereinafter except as necessary for a complete understanding of the accumulator body 90 in accordance with the present disclosure. The accumulator body 90 is configured to provide a centering mechanism that may align the injector interface end 34 of the accumulator body 90 with the accumulator bore longitudinal axis 56 and the high pressure fluid inlet port 72 of the fuel injector 70 during installation of the accumulator assembly 12. The centering mechanism in the illustrated embodiment includes an alignment groove surface 92 defining an alignment groove 94 in the accumulator body outer surface 24, and at least one fluid flow channel surface 96 defining a fluid flow channel 98.

Figure 5:
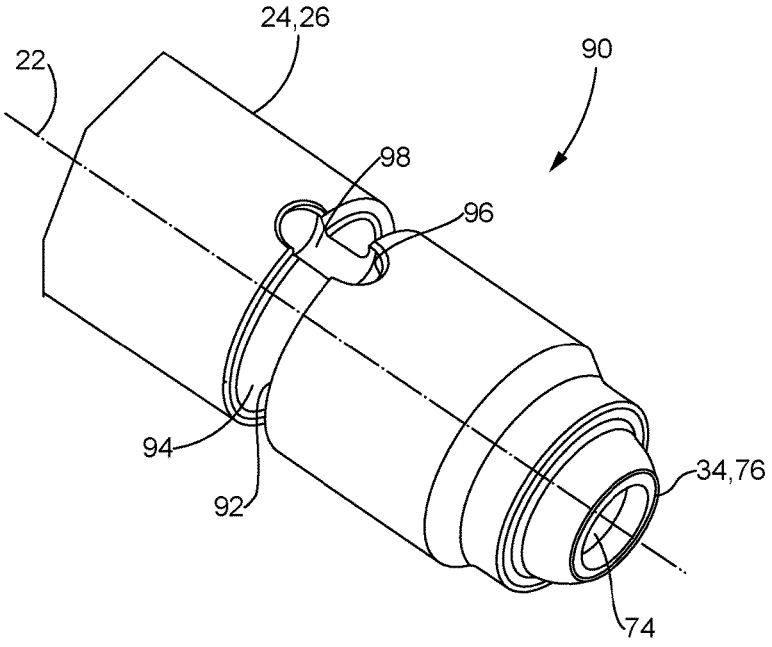
FIG. 5 is an enlarged isometric view of a portion of the accumulator body of FIG. 4 proximate an injector interface end.
Figure 6:
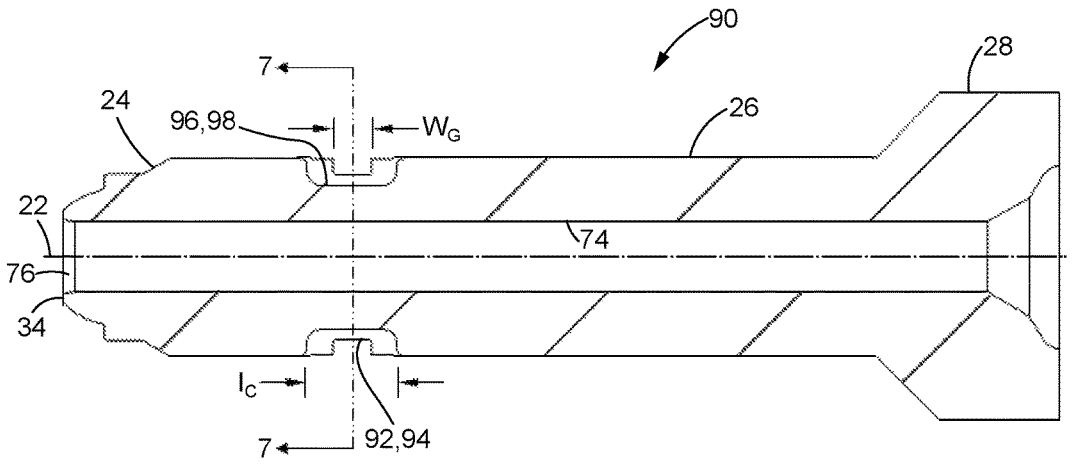
FIG. 6 is a partial cross-sectional view of the accumulator body of FIG. 4 taken through line 6-6 and showing an alignment groove and a fluid flow channel in accordance with the present disclosure.
Figure 7:
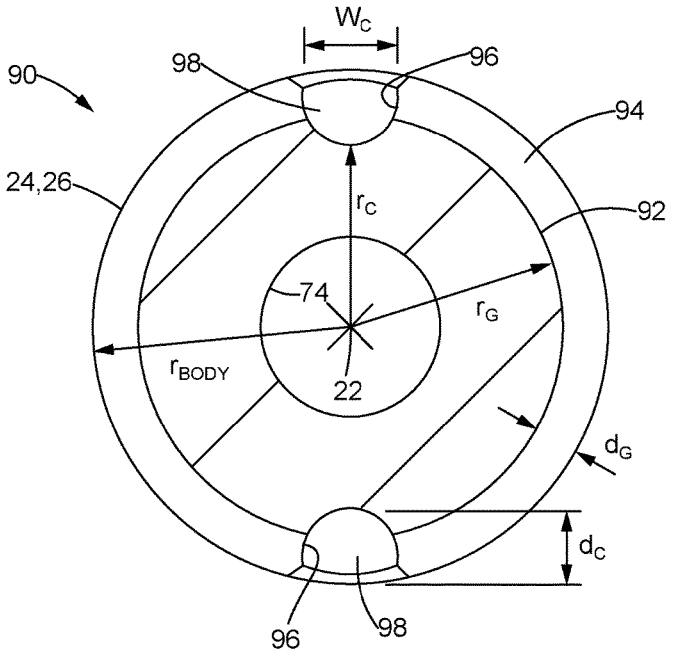
FIG. 7 is a cross-sectional view of the accumulator body of FIG. 4 taken through line 7-7 of FIG. 6.

The alignment groove 94 extends radially inwardly from the accumulator body outer surface 24 as seen in FIGS. 4-7. In this embodiment, the alignment groove 94 is located in the body section 26 closest to the injector interface end 34. However, in alternative embodiments, the alignment groove 94 may be formed in other of the body sections 28, 30, 32 as appropriate to align the accumulator body 90 within the accumulator bore 42. The alignment groove 94 is annular in this embodiment with a constant groove radius $r_G$ from the accumulator body longitudinal axis 22 to a bottom of the alignment groove 94 (FIGS. 6 and 7). The difference between an accumulator body radius $r_{BODY}$ at the first body section 26 and the alignment groove radius $r_G$ gives the alignment groove 94 an alignment groove depth $d_G$ that is radially inward from the accumulator body outer surface 24. The alignment groove 94 also has an alignment groove longitudinal width $w_G$ (FIG. 6) measured parallel to the accumulator body longitudinal axis 22.

The fluid flow channel 98 also extends radially inwardly from the accumulator body outer surface 24. In this embodiment, the accumulator body 90 has a first fluid flow channel surface 96 defining a first fluid flow channel 98, and a second fluid flow channel surface 96 located diametrically opposite the first fluid flow channel surface 96 and defining a second fluid flow channel 98. The fluid flow channels 98 are disposed longitudinally at the alignment groove 94. In the illustrated embodiment, the alignment groove 94 and the fluid flow channels 98 are longitudinally centered with respect to each other, but the fluid flow channels 98 may be longitudinally offset from the illustrated centered positions so long as fluid flow is provided as discussed further below. Each fluid flow channel 98 has a fluid flow channel radius $r_C$ (FIG. 7) from the accumulator body longitudinal axis 22 to a bottom of the fluid flow channel 98 at a maximum fluid flow channel depth $d_C$ relative to the accumulator body outer surface 24. The fluid flow channel depth $d_C$ is greater than the alignment groove depth $d_G$ so that the fluid flow channel 98 extends radially inwardly deeper into the accumulator body 90 than the alignment groove 94. The fluid flow channel 98 has a fluid flow channel longitudinal length $l_C$ (FIG. 6) parallel to the accumulator body longitudinal axis 22, and a fluid flow channel width $w_C$ (FIG. 7) perpendicular to the accumulator body longitudinal axis 22. The fluid flow channel longitudinal length $l_C$ may be at least equal to the alignment groove width $w_G$, and may be longer as necessary to create the fluid flow described below. For example, as shown in FIGS. 4-6, the fluid flow channel longitudinal length $l_C$ is greater than the alignment groove longitudinal width $w_G$ so that the fluid flow channels 98 extend longitudinally in both directions beyond the sides of the alignment groove 94.

Figure 8:
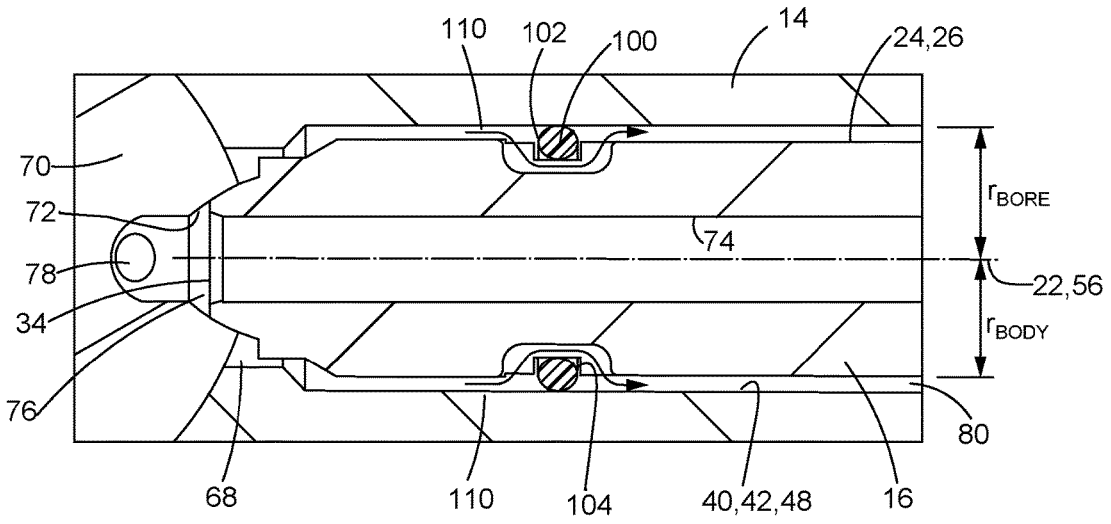
FIG. 8 is the partial cross-sectional view of the engine assembly of FIG. 3 and with the accumulator body of FIG. 4 and an accompanying seal member replacing the previously known accumulator body.
Figure 9:
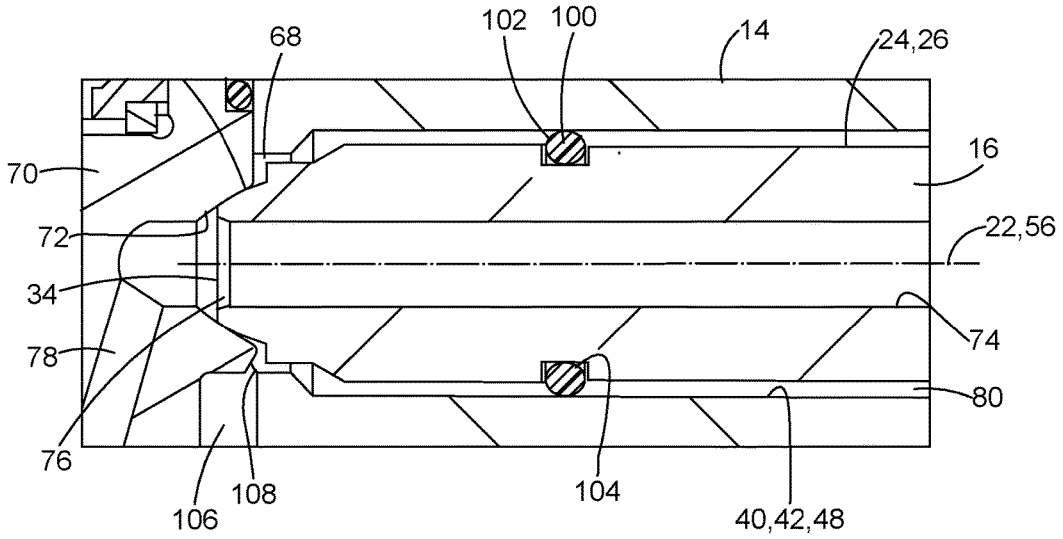
FIG. 9 is a side view of the partial cross-sectional view of FIG. 8.

Referring to FIGS. 8 and 9 that illustrate the accumulator assembly 12 installed in the cylinder head 14, the centering mechanism for the accumulator body 90 further includes a seal member 100 disposed on the accumulator body 90 and received by the alignment groove 94. In the illustrated embodiment, the seal member 100 is an O-ring seal 100 having a circular cross-section and formed from a resilient material that allows the seal member 100 to compress between the alignment groove surface 92 and the accumulator bore surface 40. In alternative embodiments, the seal member 100 may be any other appropriate type of seal, gasket, washer or the like having differing cross-sectional profiles but providing a seal outer edge surface 102 for engaging the accumulator bore surface 40 and a seal inner edge surface 104 for engaging the alignment groove surface 92.

The seal member 100 has a seal radial thickness $t_S$ from the seal inner edge surface 104 to the seal outer edge surface 102 when the seal member 100 is installed within the alignment groove 94 that is greater than the alignment groove depth $d_G$ so that the seal outer edge surface 102 extends radially outwardly beyond the accumulator body outer surface 24. Moreover, the sum of the alignment groove radius $r_G$ and the seal radial thickness $t_S$ is greater than an accumulator bore radius $r_{BORE}$ from the accumulator bore longitudinal axis 56 to the accumulator bore surface 40 so that the seal outer edge surface 102 engages the accumulator bore surface 40 when the body section 26 is disposed within the corresponding bore section 48. The engagement between the seal outer edge surface 102 and the accumulator bore surface 40 aligns the accumulator body 90 within the accumulator bore 42 for insertion of the injector interface end 34 into the bore intersection area 68 and the high pressure fluid inlet port 72 of the fuel injector 70. The longitudinal axes 22, 56 may be approximately coincidentally aligned, and the annular gap 80 may be formed about the entire circumference of the accumulator body 90.

The seal inner edge surface 104 of the seal member 100 engages the alignment groove surface 92 at locations other than at the fluid flow channels 98 so that cooling fluid from a cooling fluid passage 106 and a cooling fluid opening 108 formed between an outer surface of the fuel injector 70 and the bore intersection area 68 (FIG. 9) is prevented from flowing between the seal inner edge surface 104 and the alignment groove surface 92. However, the seal member 100 does not cover the fluid flow channels 98 so that the cooling fluid in the annular gap 80 can flow past the seal member 100 through the fluid flow channels 98 as indicated by arrows 110. The fluid flow channel depth $d_C$, longitudinal length $l_C$ and width $w_C$ are sufficiently large so that the seal inner edge surface 104 is not forced into contact with the fluid flow channel surface 96 in a manner that will prevent cooling fluid from flowing through the fluid flow channels 98 and past the seal member 100. Those skilled in the art will understand that the number and positions of fluid flow channels 98 and the dimensions such as the alignment groove depth $d_G$ and longitudinal width $w_G$, and the fluid flow channel depth $d_C$, longitudinal length $l_C$, and width $w_C$ may be varied as necessary to achieve a desired level of cooling fluid flow through the annular gap 80 during operation of the engine assembly 10.

During some installations, the fuel injector 70 may be installed with the high pressure fluid inlet port 72 not perfectly aligned with the accumulator bore longitudinal axis 56. The complimentary shapes of the high pressure fluid inlet port 72 and the injector interface end 34 may direct the injector interface end 34 into the high pressure fluid inlet port 72 and form the seal between the parts when the end 34 and the port 72 are not perfectly aligned. The engagement of the injector interface end 34 forces the accumulator body 90 out of alignment with the accumulator bore longitudinal axis 56. At the same time, the flexibility and resiliency of the seal member 100 permits the movement of the accumulator body 90 that is necessary to mate the injector interface end 34 with the high pressure fluid inlet port 72 and form the seal.

Figure 10:
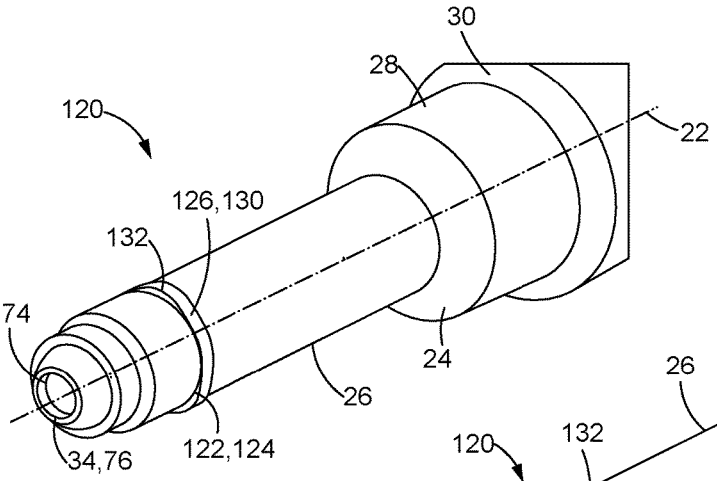
FIG. 10 is an isometric view of an alternative embodiment of an accumulator body and a seal member in accordance with the present disclosure.
Figure 11:
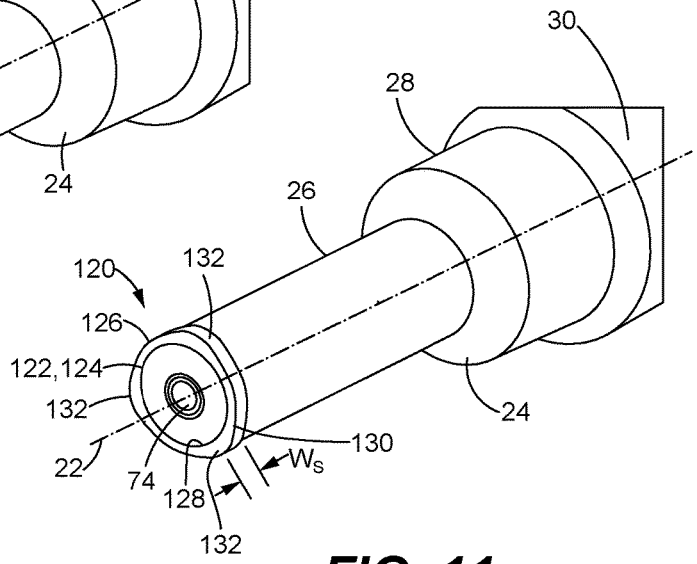
FIG. 11 is the isometric view of the accumulator body and the seal member of FIG. 10 with a portion of the accumulator body removed to expose the seal member.
Figure 12:
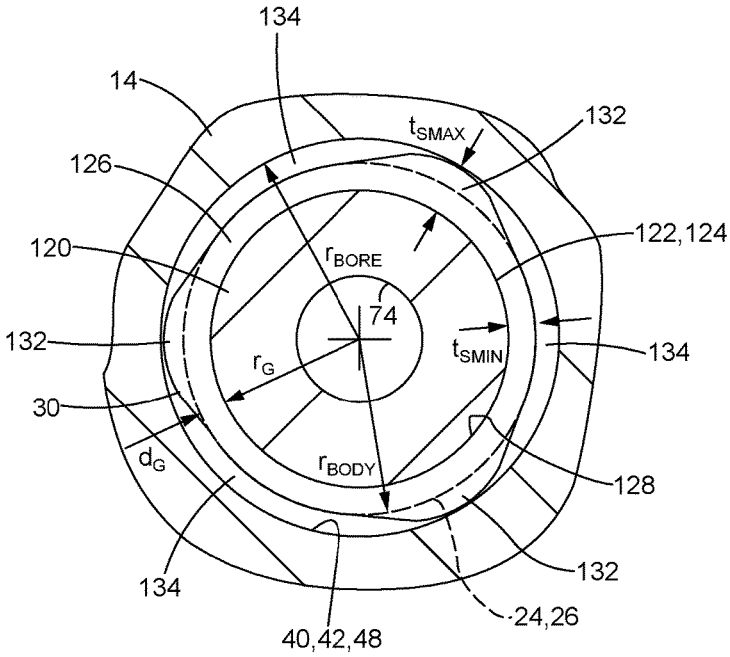
FIG. 12 is a cross-sectional view of the accumulator body and the seal member of FIG. 10 installed in the accumulator bore of the cylinder header of FIGS. 1-3.

FIGS. 10-12 illustrate an alternative embodiment of an accumulator body 120 with a centering mechanism in accordance with the present disclosure. Referring to FIG. 10, the accumulator body 120 has an alignment groove surface 122 defining an alignment groove 124 in the accumulator body outer surface 24. The alignment groove 124 may be annular and have a generally similar configuration as the alignment groove 94 with a constant alignment groove radius $r_G$, longitudinal width $w_G$ and depth $d_G$. Instead of having the fluid flow channels 98 for flow of cooling fluid past the seal member 100 in the centering mechanism for the accumulator body 90, cooling fluid flow with the accumulator body 120 is facilitated by a configuration of a seal member 126 formed from a resilient material, disposed on the accumulator body 120 and received within the alignment groove 124.

As best seen in FIGS. 11 and 12, the seal member 126 as shown has a seal inner edge surface 128 that has a complimentary shape to the alignment groove surface 122 and engages the alignment groove surface 122 to prevent fluid flow there between. The seal member 126 may also have a seal member longitudinal width $w_S$ that is greater than or equal to the alignment groove longitudinal width $w_G$ so that the seal member 126 engages the sides of the alignment groove 124. However, the seal member 126 may be narrower than the alignment groove 124 so that the seal member 126 does not engage one or both sides of the alignment groove 124. The seal member 126 further includes a seal outer edge surface 130 at the radial outer side of the seal member 126. In the seal member 126, the seal radial thickness $t_S$ (FIG. 12) between the seal inner edge surface 128 and the seal outer edge surface 130 is variable between a minimum seal radial thickness $t_{SMIN}$ and a maximum seal radial thickness $t_{SMAX}$. The minimum seal radial thickness $t_{SMIN}$ may be less than or equal to the alignment groove depth $d_G$ so that portions of the seal member 126 with the radial seal thickness $t_S$ being less than or equal to the alignment groove depth $d_G$ do not extend past the accumulator body outer surface 24. The maximum seal radial thickness $t_{SMAX}$ is greater than the alignment groove depth $d_G$ so that portions of the seal member 126 with the seal radial thickness $t_S$ greater than the alignment groove depth $d_G$ extend radially outwardly past the accumulator body outer surface 24. Where the alignment groove radius $r_G$ plus the seal radial thickness $t_S$ is greater than the accumulator bore radius $r_{BORE}$, the corresponding portions of the seal outer edge surface 130 will engage the accumulator bore surface 40 when the longitudinal axes 22, 56 are aligned.

As shown, the seal member 126 has three accumulator bore engagement portions or seal nodes 132 circumferentially spaced about the seal outer edge surface 130 and having the maximum seal radial thickness $t_{SMAX}$. The seal member 126 could have as few as two seal nodes 132 or additional seal nodes 132 if necessary. When the accumulator body 120 is inserted into the accumulator bore 42, the seal nodes 132 engage the accumulator bore surface 40 when the body section 26 is disposed within the corresponding bore section 48. The engagement between the seal nodes 132 and the accumulator bore surface 40 aligns the accumulator body 120 within the accumulator bore 42 for insertion of the injector interface end 34 into the bore intersection area 68 and the high pressure fluid inlet port 72 of the fuel injector 70. The longitudinal axes 22, 56 may be approximately coincidentally aligned, and the annular gap 80 may be formed about the entire circumference of the accumulator body 120.

In the portions of the seal outer edge surface 130 between adjacent seal nodes 132 where the alignment groove radius $r_G$ plus the seal radial thickness $t_S$ is less than the accumulator bore radius $r_{BORE}$, the seal outer edge surface 130 does not engage the accumulator bore surface 40, and fluid flow gaps 134 are created that will allow cooling fluid to flow past the seal member 126 between the seal outer edge surface 130 and the accumulator bore surface 40. If the high pressure fluid inlet port 72 is not aligned with the accumulator bore longitudinal axis 56, the flexibility and resiliency of the seal member 126 will permit movement of the accumulator body 120 to allow the injector interface end 34 and the high pressure fluid inlet port 72 to mate and seal in a similar manner as the seal member 100 discussed above.

Figure 13:
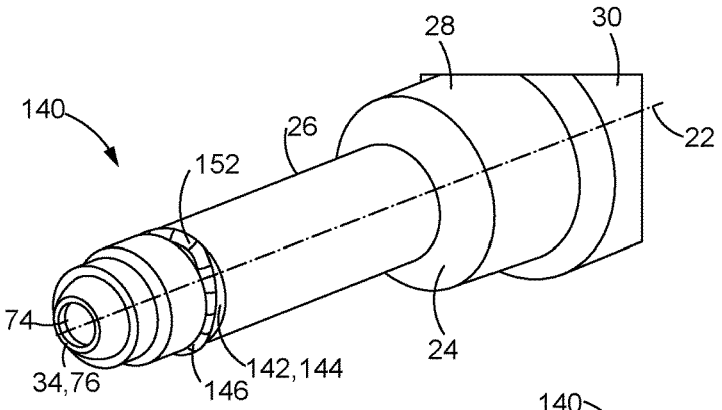
FIG. 13 is an isometric view of a further alternative embodiment of an accumulator body and a seal member in accordance with the present disclosure.
Figure 14:
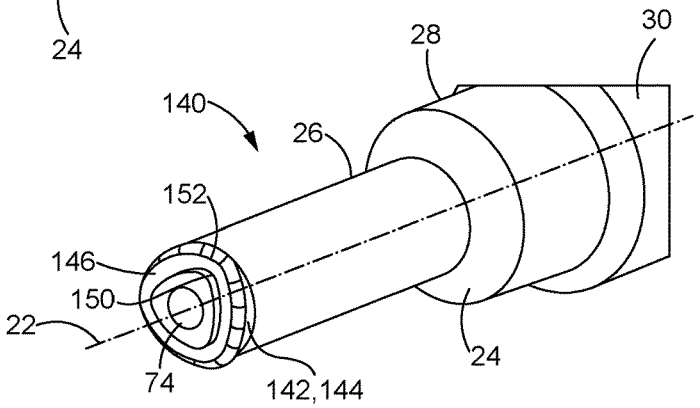
FIG. 14 is the isometric view of the accumulator body and the seal member of FIG. 13 with a portion of the accumulator body removed to expose the seal member.
Figure 15:
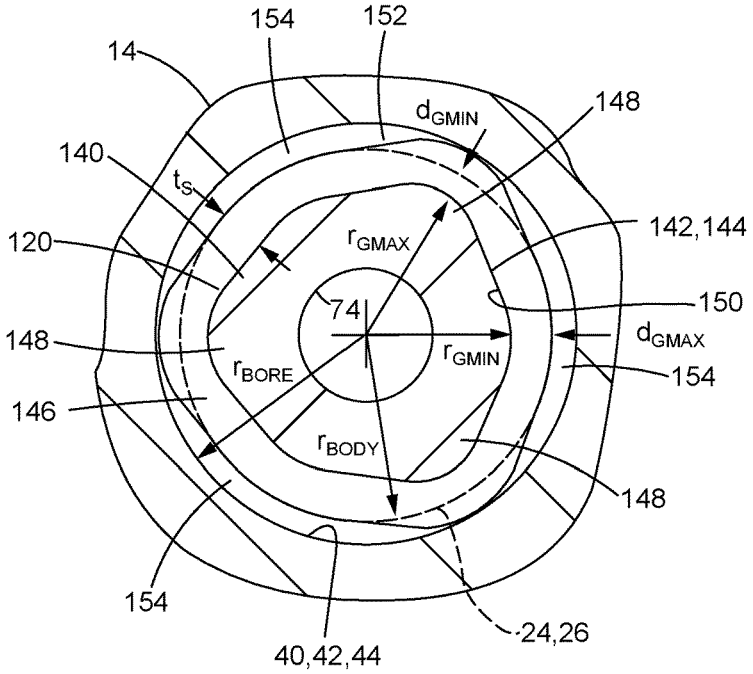
FIG. 15 is a cross-sectional view of the accumulator body and the seal member of FIG. 13 installed in the accumulator bore of the cylinder header of FIGS. 1-3.

FIGS. 13-15 illustrate a further alternative embodiment of an accumulator body 140 with a centering mechanism in accordance with the present disclosure. Referring to FIG. 13, the accumulator body 140 has an alignment groove surface 142 defining an alignment groove 144 in the accumulator body outer surface 24. As best seen in FIGS. 14 and 15, the alignment groove 144 may have a contoured cross-sectional shape that will force a corresponding shape of a seal member 146 that will engage the accumulator bore surface 40 to align the accumulator body 140 while allowing cooling fluid to flow past the seal member 146. In the alignment groove 144 as shown, the alignment groove radius $r_G$ (FIG. 15) is variable between a minimum alignment groove radius $r_{GMIN}$ and a maximum alignment groove radius $r_{GMAX}$. Correspondingly, the alignment groove depth $d_G$ will vary between a minimum alignment groove depth $d_{GMIN}$ at the maximum alignment groove radius $r_{GMAX}$ and a maximum alignment groove depth $d_{GMAX}$ at the minimum alignment groove radius $r_{GMIN}$. As shown, the alignment groove 144 has three groove nodes 148 circumferentially spaced about the alignment groove surface 142 and having the alignment groove radius $r_{GMAX}$ and the minimum alignment groove depth $d_{GMIN}$. The alignment groove 144 could have as few as two groove nodes 148 or additional groove nodes 148 if necessary.

The seal member 146 as shown is an O-ring seal having a circular cross-section, but may be any other appropriate annular seal, gasket or washer having other cross-sectional shapes. The seal radial thickness $t_S$ of the seal member 146 between a seal inner edge surface 150 and a seal outer edge surface 152 may be constant when the seal member 146 is not installed on the accumulator body 140 in the alignment groove 144. The seal radial thickness $t_S$ may vary, however, when the seal member 146 is installed within the alignment groove 144 and the groove nodes 148 stretch the seal member 146 to conform to the shape of the alignment groove 144. The seal inner edge surface 150 may conform to the shape of the alignment groove surface 122 and engage the alignment groove surface 122 to prevent fluid flow there between. The seal member longitudinal width $w_S$ of the seal member 146 may be greater than or less that the alignment groove longitudinal width $w_G$ to engage or not engage both sides of the alignment groove 144 depending on the requirements for a particular implementation of the accumulator assembly 12.

The maximum alignment groove depth $d_{GMAX}$ may be greater than or equal to the seal radial thickness $t_S$ of a corresponding portion of the seal member 146 so that portions of the seal member 146 with the radial seal thickness $t_S$ being less than or equal to the alignment groove depth $d_G$ do not extend past the accumulator body outer surface 24. The minimum alignment groove depth $d_{GMIN}$ is less than the seal radial thickness $t_S$ of a corresponding portion of the seal member 146 so that portions of the seal member 146 with the seal radial thickness $t_S$ greater than the alignment groove depth $d_G$ extend radially outwardly past the accumulator body outer surface 24. Where the alignment groove radius $r_G$ plus the seal radial thickness $t_S$ is greater than the accumulator bore radius $r_{BORE}$, such as at the groove nodes 148, corresponding accumulator bore engagement portions of the seal outer edge surface 152 will engage the accumulator bore surface 40 when the longitudinal axes 22, 56 are aligned.

When the accumulator body 140 is inserted into the accumulator bore 42, the accumulator bore engagement portions of the seal outer edge surface 152 proximate the groove nodes 148 engage the accumulator bore surface 40 when the body section 26 is disposed within the corresponding bore section 48. The engagement between the seal outer edge surface 152 at the groove nodes 148 and the accumulator bore surface 40 aligns the accumulator body 140 within the accumulator bore 42 for insertion of the injector interface end 34 into the bore intersection area 68 and the high pressure fluid inlet port 72 of the fuel injector 70. The longitudinal axes 22, 56 may be approximately coincidentally aligned, and the annular gap 80 may be formed about the entire circumference of the accumulator body 140.

In the portions of the seal outer edge surface 152 between adjacent groove nodes 148 where the alignment groove radius $r_G$ plus the seal radial thickness $t_S$ is less than the accumulator bore radius $r_{BORE}$, the seal outer edge surface 152 does not engage the accumulator bore surface 40, and fluid flow gaps 154 are created that will allow cooling fluid to flow past the seal member 146 between the seal outer edge surface 152 and the accumulator bore surface 40. If the high pressure fluid inlet port 72 is not aligned with the accumulator bore longitudinal axis 56, the flexibility and resiliency of the seal member 146 will permit movement of the accumulator body 140 to allow the injector interface end 34 and the high pressure fluid inlet port 72 to mate and seal in a similar manner as the seal members 100, 126 discussed above.

INDUSTRIAL APPLICABILITY

The accumulator centering mechanisms illustrated and described herein center the accumulator bodies 90, 120, 140 within the accumulator bore 42 along the accumulator bore longitudinal axis 56 and with the high pressure fluid inlet port 72 of the fuel injector 70. The centering of the accumulator bodies 90, 120, 140 avoids having the injector interface end 34 of the accumulator bodies 90, 120, 140 hit the accumulator bore surface 40 and the outer surface of the fuel injector 70 and causing damage to the components during installation of the accumulator assembly 12 and the fuel injector 70. At the same time, the resiliency of the seal members 100, 126, 146 allows the accumulator bodies 90, 120, 140 to be forced off center in order for the injector interface end 34 to properly align and be received by the high pressure fluid inlet port 72 of the fuel injector 70 if the port 72 is not aligned with the accumulator bore longitudinal axis 56. The flexibility in alignment allows the injector interface end 34 and the high pressure fluid inlet port 72 to properly mate and form the seal there between. At the same time, the configurations of the alignment grooves 94, 124, 144 and the corresponding seal members 100, 126, 146 allow cooling fluid to flow past the seal members 100, 126, 146 through the annular gap 80, over the accumulator body outer surface 24 and out through the drain port 60 to cool the accumulator assembly 12 during operation of the engine assembly 10.

While the preceding text sets forth a detailed description of numerous different embodiments, it should be understood that the legal scope of protection is defined by the words of the claims set forth at the end of this patent. The detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims defining the scope of protection.

It should also be understood that, unless a term was expressly defined herein, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to herein in a manner consistent with a single meaning, that is done for sake of clarity only so as to not confuse the reader, and it is not intended that such claim term be limited, by implication or otherwise, to that single meaning.

What is claimed is:

1. An accumulator body for an accumulator assembly in an engine assembly of a machine, where the engine assembly further includes a fuel injector having a high pressure fluid inlet port, and a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned, the accumulator body comprising:

an injector interface end dimensioned to be received by the high pressure fluid inlet port of the fuel injector;

an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis;

an alignment groove surface defining an alignment groove in the accumulator body outer surface having an alignment groove depth that is radially inward from the accumulator body outer surface and an alignment groove longitudinal width; and a first fluid flow channel surface defining a first fluid flow channel in the accumulator body that is disposed at the alignment groove, the first fluid flow channel having a fluid flow channel depth that is radially inward from the accumulator body outer surface and is greater than the alignment groove depth, and a fluid flow channel longitudinal length that is at least equal to the alignment groove longitudinal width, wherein, when an annular seal member is disposed on the accumulator body and within the alignment groove and the accumulator body is disposed within the accumulator bore, a seal outer edge surface engages the accumulator bore surface to align the accumulator body within the accumulator bore, a seal inner edge surface engages the alignment groove surface at locations other than the at the first fluid flow channel to prevent fluid flow between the seal inner edge surface and the alignment groove surface, and the seal inner edge surface does not engage the first fluid flow channel surface to allow fluid in the annular gap to flow past the seal member between the seal inner edge surface and the first fluid flow channel surface.

2. The accumulator body of claim 1, wherein the fluid flow channel longitudinal length is greater than the alignment groove longitudinal width.

3. The accumulator body of claim 2, wherein the first fluid flow channel is longitudinally aligned with the alignment groove so that the first fluid flow channel extends longitudinally in both directions beyond the alignment groove.

4. The accumulator body of claim 1, comprising a second fluid flow channel surface diametrically opposite the first fluid flow channel surface and defining a second fluid flow channel in the accumulator body that is disposed at the alignment groove, the second fluid flow channel having the fluid flow channel depth and the fluid flow channel longitudinal length of the first fluid flow channel, wherein the seal inner edge surface engages the alignment groove surface at locations other than the at the first fluid flow channel and the second fluid flow channel to prevent fluid flow between the seal inner edge surface and the alignment groove surface, and the seal inner edge surface does not engage the second fluid flow channel surface to allow fluid to flow past the seal member between the seal inner edge surface and the second fluid flow channel surface.

5. An accumulator assembly comprising:

the accumulator body of claim 1; and a seal member disposed on the accumulator body and within the alignment groove and having a seal outer edge surface and a seal inner edge surface, wherein the seal member does not cover the first fluid flow channel and the seal inner edge surface does not engage the first fluid flow channel surface so that cooling fluid in the annular gap can flow past the seal member through the first fluid flow channel between the seal inner edge surface and the first fluid flow channel.

6. The accumulator assembly of claim 5, wherein the seal member has a seal radial thickness relative to the accumulator body longitudinal axis that is greater than the alignment groove depth so that the seal outer edge surface extends radially outwardly beyond the accumulator body outer surface and engages the accumulator bore surface to align the accumulator body for insertion of the injector interface end into the high pressure fluid inlet port of the fuel injector and to maintain the annular gap between the accumulator bore surface and the accumulator body outer surface.

7. The accumulator assembly of claim 5, wherein the seal inner edge surface of the seal member engages the alignment groove surface at locations other than at the first fluid flow channel to prevent flow of cooling fluid between the seal inner edge surface of the seal member and the alignment groove surface.

8. An accumulator assembly for an engine assembly of a machine, where the engine assembly further includes a fuel injector having a high pressure fluid inlet port, and a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned, the accumulator assembly comprising:

an accumulator body comprising an injector interface end dimensioned to be received by the high pressure fluid inlet port of the fuel injector, an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis, and an alignment groove surface defining an alignment groove in the accumulator body outer surface having an alignment groove depth that is radially inward from the accumulator body outer surface and an alignment groove longitudinal width; and a seal member disposed on the accumulator body and within the alignment groove and having a seal inner edge surface engaging the alignment groove surface to prevent fluid flow there between, and a seal outer edge surface having a plurality of accumulator bore engagement portions that extend radially outwardly beyond the accumulator body outer surface and engage the accumulator bore surface to align the accumulator body for insertion of the injector interface end into the high pressure fluid inlet port of the fuel injector, wherein the seal outer edge surface does not engage the accumulator bore surface between adjacent accumulator bore engagement portions to define fluid flow gaps between the seal outer edge surface and the accumulator bore surface so that cooling fluid can flow past the seal member through the fluid flow gaps between the seal outer edge surface and the accumulator bore surface.

9. The accumulator assembly of claim 8, wherein a seal radial thickness between the seal inner edge surface and the seal outer edge surface is variable between a minimum seal radial thickness that is less than or equal to the alignment groove depth and a maximum seal radial thickness that is greater than the alignment groove depth at the plurality of accumulator bore engagement portions.

10. The accumulator assembly of claim 8, wherein the alignment groove is annular and the seal inner edge surface is annular.

11. The accumulator assembly of claim 8, wherein an alignment groove radius from the accumulator body longitudinal axis to the alignment groove surface is variable between a minimum alignment groove radius where the alignment groove depth is greater than or equal to a seal radial thickness between the seal inner edge surface and the seal outer edge surface and a maximum alignment groove radius where the alignment groove depth is less than the seal radial thickness and a corresponding portion of the seal member forms one of the plurality of accumulator bore engagement portions.

12. The accumulator assembly of claim 11, wherein the seal member is an O-ring seal and the seal radial thickness between the seal inner edge surface and the seal outer edge surface is constant when the O-ring seal is not installed on the accumulator body in the alignment groove.

13. The accumulator assembly of claim 8, wherein the plurality of accumulator bore engagement portions comprises three accumulator bore engagement portions.

14. An engine assembly of a machine, the engine assembly comprising:

a fuel injector having a high pressure fluid inlet port;

a cylinder head having a fuel injector bore surface defining a fuel injector bore in which the fuel injector is disposed, and an accumulator bore surface defining an accumulator bore having an accumulator bore inner diameter and an accumulator bore longitudinal axis and intersecting the fuel injector bore at a bore intersection area at which the high pressure fluid inlet port is aligned;

an accumulator body comprising an injector interface end dimensioned to be received by the high pressure fluid inlet port of the fuel injector, an accumulator body outer surface having a shape that is complimentary to the accumulator bore surface, an accumulator body longitudinal axis and an accumulator body outer diameter that is less than the accumulator bore inner diameter so that the accumulator bore surface and the accumulator body outer surface define an annular gap there between when the accumulator body is disposed within the accumulator bore and the accumulator body longitudinal axis is aligned coincident with the accumulator bore longitudinal axis, and an alignment groove surface defining an alignment groove in the accumulator body outer surface having an alignment groove depth that is radially inward from the accumulator body outer surface and an alignment groove longitudinal width; and a seal member disposed on the accumulator body and within the alignment groove and having a seal inner edge surface engaging the alignment groove surface and a seal outer edge surface engaging the accumulator bore surface to align the accumulator body for insertion of the injector interface end into the high pressure fluid inlet port of the fuel injector, wherein the alignment groove and the seal member are configured to define a plurality of accumulator bore engagement portions of the seal outer edge surface that engage the accumulator bore surface, and to define a plurality of gap portions of the seal outer edge surface that do not engage the accumulator bore surface and define fluid flow gaps between the seal outer edge surface and the accumulator bore surface so that cooling fluid can flow past the seal member through the fluid flow gaps when the accumulator body is installed in the accumulator bore and the accumulator bore engagement surfaces of the seal outer edge surface engage the accumulator bore surface.

15. The engine assembly of claim 14, wherein the accumulator body comprises a first fluid flow channel surface defining a first fluid flow channel in the accumulator body that is disposed at the alignment groove, the first fluid flow channel having a fluid flow channel depth that is radially inward from the accumulator body outer surface and is greater than the alignment groove depth, and a fluid flow channel longitudinal length that is at least equal to the alignment groove longitudinal width, wherein the seal inner edge surface of the seal member does not engage the first fluid flow channel surface so that cooling fluid in the annular gap can flow past the seal member through the first fluid flow channel.

16. The engine assembly of claim 15, wherein the accumulator body comprises a second fluid flow channel surface diametrically opposite the first fluid flow channel surface and defining a second fluid flow channel in the accumulator body that is disposed at the alignment groove, the second fluid flow channel having the fluid flow channel depth and the fluid flow channel longitudinal length of the first fluid flow channel, wherein the seal inner edge surface of the seal member does not engage the second fluid flow channel so that cooling fluid in the annular gap can flow past the seal member through the second fluid flow channel.

17. The engine assembly of claim 14, wherein the seal inner edge surface engages the alignment groove surface to prevent fluid flow there between, wherein a seal radial thickness between the seal inner edge surface and the seal outer edge surface is variable between a minimum seal radial thickness that is less than or equal to the alignment groove depth and a maximum seal radial thickness that is greater than the alignment groove depth so that the seal member extends radially outwardly beyond the accumulator body outer surface at the plurality of accumulator bore engagement portions that engage the accumulator bore surface, and wherein the seal outer edge surface does not engage the accumulator bore surface at the fluid flow gaps between adjacent accumulator bore engagement portions so that cooling fluid can flow past the seal member through the fluid flow gaps between the seal outer edge surface and the accumulator bore surface.

18. The engine assembly of claim 17, wherein the plurality of accumulator bore engagement portions comprises three accumulator bore engagement portions.

19. The engine assembly of claim 14, wherein the seal inner edge surface engages the alignment groove surface to prevent fluid flow there between, wherein an alignment groove radius from the accumulator body longitudinal axis to the alignment groove surface is variable between a minimum alignment groove radius where the alignment groove depth is greater than or equal to a seal radial thickness between the seal inner edge surface and the seal outer edge surface and a maximum alignment groove radius where the alignment groove depth is less than the seal radial thickness so that the seal member extends radially outwardly beyond the accumulator body outer surface at the plurality of accumulator bore engagement portions that engage the accumulator bore surface, and wherein the seal outer edge surface does not engage the accumulator bore surface at the fluid flow gaps between adjacent accumulator bore engagement portions so that cooling fluid can flow past the seal member through the fluid flow gaps between the seal outer edge surface and the accumulator bore surface.

20. The engine assembly of claim 19, wherein the plurality of accumulator bore engagement portions comprises three accumulator bore engagement portions.

* * * * *